US008763432B2

(12) United States Patent
Yoon et al.

(10) Patent No.: US 8,763,432 B2
(45) Date of Patent: Jul. 1, 2014

(54) LAUNDRY DEVICE

(75) Inventors: Ju Han Yoon, Changwon-si (KR); Il Tak Han, Gimhae-si (KR); Sung Gi Hwang, Changwon-si (KR); Seong Kyu Kim, Gyeongsangnam-do (KR); Seon Il Heo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1027 days.

(21) Appl. No.: 12/097,777

(22) PCT Filed: Dec. 21, 2006

(86) PCT No.: PCT/KR2006/005631

§ 371 (c)(1),
(2), (4) Date: Sep. 24, 2008

(87) PCT Pub. No.: WO2007/073105

PCT Pub. Date: Jun. 28, 2007

(65) Prior Publication Data

US 2009/0126419 A1 May 21, 2009

(30) Foreign Application Priority Data

| | | |
|---|---|---|
| Dec. 23, 2005 | (KR) | 10-2005-0128718 |
| Dec. 29, 2005 | (KR) | 10-2005-0134004 |
| Dec. 29, 2005 | (KR) | 10-2005-0134005 |
| Sep. 5, 2006 | (KR) | 10-2006-0085125 |
| Sep. 11, 2006 | (KR) | 10-2006-0087288 |

(51) Int. Cl.

| | |
|---|---|
| ***D06F 37/00*** | (2006.01) |
| ***D06F 37/26*** | (2006.01) |
| ***D06F 39/12*** | (2006.01) |
| ***D06F 39/14*** | (2006.01) |
| ***A47L 15/42*** | (2006.01) |

(52) U.S. Cl.

CPC ..... *A47L 15/4274* (2013.01); *A47B 2220/03* (2013.01); *D06F 39/14* (2013.01); *D06F 39/12* (2013.01)

USPC ..... 68/12.27; 68/3 R; 68/212; 312/228; 312/265.5; 312/265.6

(58) Field of Classification Search

CPC ..... D06F 39/12; D06F 39/14; A47L 15/4274; A47B 2220/03

USPC ..... 68/3 R, 12.27, 212; 312/228, 265.5, 312/265.6

See application file for complete search history.

(56) References Cited

U.S. PATENT DOCUMENTS

| | | | | |
|---|---|---|---|---|
| 1,987,540 | A * | 1/1935 | Rekonty | 70/172 |
| 3,588,213 | A | 6/1971 | Braga et al. | 312/214 |

(Continued)

FOREIGN PATENT DOCUMENTS

| | | |
|---|---|---|
| CN | 2372343 Y | 4/2000 |
| CN | 2549032 Y | 5/2003 |

(Continued)

OTHER PUBLICATIONS

Chinese Office Action dated Aug. 7, 2009 for Application No. 200710192923.1.

(Continued)

*Primary Examiner* — Alexander Markoff
(74) *Attorney, Agent, or Firm* — Ked & Associates, LLP

(57) ABSTRACT

A laundry device is provided in which a control panel may be mounted/dismounted conveniently according to an arrangement of the laundry device. The laundry device may include a body case which forms an exterior of the laundry device, a panel frame mounted to an upper end or a lower end of a front of the body case, a control panel selectively mounted to a front of the panel frame, and a falling off preventive portion for preventing the control panel from being inadvertently separated from the panel frame.

14 Claims, 14 Drawing Sheets

(56) References Cited

U.S. PATENT DOCUMENTS

| | | | | |
|---|---|---|---|---|
| 3,983,387 | A | 9/1976 | Van Steenhoven et al. | 240/147 |
| 4,288,133 | A | 9/1981 | Deatherage | 312/279 |
| 4,428,444 | A * | 1/1984 | Whittaker et al. | 177/187 |
| 4,798,424 | A | 1/1989 | Coates et al. | 312/257 |
| 4,974,262 | A | 12/1990 | Rosen | 4/236 |
| 5,357,565 | A | 10/1994 | Butler, III et al. | 379/412 |
| 5,738,424 | A | 4/1998 | Katz et al. | 312/293.3 |
| 5,901,417 | A | 5/1999 | Alexiou | 24/90.5 |
| 6,065,820 | A | 5/2000 | Fleissner et al. | 312/265.5 |
| 6,070,295 | A | 6/2000 | Hulsebus | 16/254 |
| 6,109,710 | A | 8/2000 | Wu et al. | 312/223.2 |
| 6,502,431 | B1 | 1/2003 | Yamano et al. | 68/3 |
| 7,395,683 | B2 | 7/2008 | Kim et al. | 68/12.27 |
| 7,490,492 | B2 | 2/2009 | Kim et al. | 68/12.27 |
| 7,748,243 | B2 | 7/2010 | Park et al. | 68/196 |
| 2004/0107738 | A1 | 6/2004 | Kim et al. | 68/3 |
| 2005/0122011 | A1 | 6/2005 | Hwang et al. | 312/223.2 |
| 2005/0178164 | A1 | 8/2005 | Kim et al. | 68/3 |
| 2005/0179347 | A1 | 8/2005 | Kim et al. | 312/228 |
| 2005/0183469 | A1 | 8/2005 | Kang | 68/3 |
| 2005/0268667 | A1 | 12/2005 | Yoon et al. | |
| 2006/0255700 | A1 | 11/2006 | Park et al. | 312/228 |
| 2007/0052332 | A1 | 3/2007 | Kim | 312/228 |
| 2007/0209403 | A1 | 9/2007 | Byun et al. | 68/3 |
| 2008/0053159 | A1 | 3/2008 | Hwang et al. | 68/12.01 |
| 2009/0066205 | A1 | 3/2009 | Park et al. | 312/228 |
| 2009/0126419 | A1 | 5/2009 | Yoon et al. | 68/212 |
| 2009/0217545 | A1 | 9/2009 | Banicevic et al. | 34/89 |

FOREIGN PATENT DOCUMENTS

| | | | |
|---|---|---|---|
| CN | 1535805 | A | 10/2004 |
| DE | 3803614 | | 8/1989 |
| DE | 42 40 888 | A1 | 6/1994 |
| EP | 0 875 196 | B1 | 11/1998 |
| EP | 0 893 532 | A1 | 1/1999 |
| GB | 2 243 770 | A | 11/1991 |
| JP | 07323191 | A * | 12/1995 |
| JP | 11-057292 | A | 3/1999 |
| JP | 11-333193 | | 12/1999 |
| JP | 2000-271392 | A | 10/2000 |
| KR | 20-1998-0031814 | | 8/1998 |
| KR | 10-0479105 | | 3/2005 |
| KR | 2005042320 | A * | 5/2005 |
| KR | 10-2005-0054201 | | 6/2005 |
| KR | 10-2005-0066532 | | 6/2005 |
| KR | 10-2005-0081455 | | 8/2005 |
| KR | 10-2005-0081455 | A | 8/2005 |
| KR | 20-0395274 | Y1 | 9/2005 |
| WO | WO 02/090640 | A1 | 11/2002 |
| WO | WO 2006/126812 | A2 | 11/2006 |

OTHER PUBLICATIONS

PCT International Search Report dated May 21, 2007.
International Search Report dated Apr. 17, 2007.
Office Action dated Oct. 8, 2010 issued in U.S. Appl. No. 11/848,705.
International PCT Search Report dated Nov. 28, 2008.
Japanese Office Action dated Aug. 23, 2011 issued in Application No. 2008-547111.
U.S. Office Action dated Sep. 27, 2011 issued in U.S. Appl. No. 12/097,783.
Notice of Allowance issued in U S. Appl. No. 12/097,783 dated Jul. 10, 2012.
European Search Report issued in Application No. 06835372.1 dated Jul. 11, 2013.
Korean Notice of Allowance dated Aug. 21, 2013 for corresponding Application No. 10-2005-0128789.
U.S. Final Office Action dated Jun. 14, 2010 issued in U.S. Appl. No. 11/848,705.

* cited by examiner

LAUNDRY DEVICE

TECHNICAL FIELD

The present invention relates to a control panel assembly in a laundry device and a laundry device including the same, and more particularly, to a control panel assembly of which fabrication is easy, and is designed to make an easy recognition of a selected operation condition; and a laundry device, including the same.

BACKGROUND ART

In general, in the laundry device, there are washing machines for washing laundry, washing and drying machines for washing and drying the laundry, and clothes laundry device for drying laundry or the like only.

The laundry device is also sorted as a top loading type and a front loading type depending on a direction of introduction of the laundry (or a type of drum mounting).

In the top loading type laundry device, the laundry is introduced into/taken out of the laundry device through a top thereof, and the drum is upright.

In the front loading type laundry device, the laundry is introduced into/taken out of the laundry device through a front thereof, and the drum is laid down in a horizontal direction.

The front loading type laundry device is advantageous in that more than two of them can be stacked as the case demand to minimize an installation space.

For an example, referring to FIG. 1, the clothes laundry device 2 is stacked on the drum type washing machine or the washing and drying machine 1. Of course, though not shown, two drum type washing machines, or two clothes laundry devices may be stacked.

However, when the two laundry devices are used in such a stacked state, an overlying laundry device is inconvenient to control since the overlying laundry device has a control panel positioned relatively high compared to a height of a user.

DISCLOSURE OF INVENTION

Technical Problem

An object of the present invention devised to solve the problem lies on providing a laundry device in which a control panel is designed to be mounted/dismounted conveniently according to a state of arrangement of the laundry device.

Technical Solution

To achieve these objects and other advantages and in accordance with the purpose of the invention, as embodied and broadly described herein, a laundry device includes a body case which forms an exterior of the laundry device, a panel frame mounted to an upper side or a lower side of a front of the body case, a control panel selectively mounted to a front of the panel frame detachably for making various control required for operation, and a falling off preventive portion for preventing the control panel from falling off the panel frame in a front side thereof.

The falling off preventive portion includes a bracket projected forward from at least one side of the panel frame, and opposite projections and slots at the brackets and opposite sides of the control panel respectively.

There are at least two of the projections and the slots, respectively.

The projection is formed on the control panel, and the slot is formed at the bracket.

The projection includes a supporting end formed as one unit with the control panel, and a bent end bent downward or upward from an inner edge of the supporting end, and the slot includes a horizontal slot for placing the supporting end therein, and a vertical slot for placing the bent end therein.

The projection may be formed on the bracket and the slot may be formed in the control panel.

The projection may include a supporting end formed as one unit with the bracket, and a bent end bent downward or upward from an inner edge of the supporting end, and the slot may include a horizontal slot for placing the supporting end therein, and a vertical slot for placing the bent end therein.

The laundry device further includes a moving preventive member for preventing the control panel from moving after the control panel is mounted to the panel frame.

The falling off preventive portion is formed on one side of each of the control panel and the panel frame opposite to each other, and the moving preventive member is formed on the other side of each of the control panel and the panel frame opposite to each other.

The moving preventive member includes a bracket on the panel frame, a hole in the bracket, a screw hole in the control panel opposite to the hole in the bracket, and a screw fastened to the hole and the screw hole.

The laundry device further includes a hiding cap for hiding the screw so as to be invisible from an outside of the laundry device.

The control panel has a recess and a screw hole is formed in the recess.

The laundry device further includes a hiding cap to be placed in the recess for hiding the recess and the screw at a time.

The recess has hinge holes, and the hiding cap has hinge projections matched to the hinge holes, so that the hiding cap rotates around a hinge axis of the hinge projections for the hiding cap to expose or hide the recess and the screw.

The recess has hinge projections, and the hiding cap has hinge holes matched to the hinge projections, so that the hiding cap rotates around a hinge axis of the hinge projections for the hiding cap to expose or hide the recess and the screw.

The recess has a falling off preventive portion on a bottom, and the hiding cap has a hook portion in correspondence to the falling off preventive portion, so that the hook portion rotates while the hook portion is held at the falling off preventive portion, for the hiding cap to expose or hide the recess and the screw.

The hiding cap has a holding slot and the recess has a holding projection.

The hiding cap has a holding projection and the recess has a holding slot.

The panel frame is provided both to the upper side and the lower side of the front of the body case, and a cover panel is further provided to the panel frame on a side the panel frame no control panel is mounted thereon for selective mounting of the cover panel to the panel frame, detachably.

A structure for mounting/dismounting the cover panel to/from the panel frame is identical to a structure for mounting/dismounting the control panel to/from the panel frame.

In another aspect of the present invention, a laundry device includes a body case which forms an exterior of the laundry device, a panel frame mounted to a front of the body case, a control panel selectively mounted to a front of the panel frame detachably for making various control required for operation, a falling off preventive portion formed one side of the panel frame and an inside of one side of the control panel in conformity with each other for sliding the control panel from one side of the panel frame to the other side thereof to secure the control panel to the panel frame and to prevent the control panel from falling off the panel frame in a front side thereof, and a moving preventive member for placing in one side of the control panel for fastening the control panel to the panel frame.

The laundry device further includes a deco portion provided to a top surface of a horizontal end of the panel frame to form a front portion of the top surface of the body case.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

A laundry device in accordance with a first preferred embodiment of the present invention will be described in detail, with reference to FIGS. 2 to 6 attached hereto.

Figure 1:
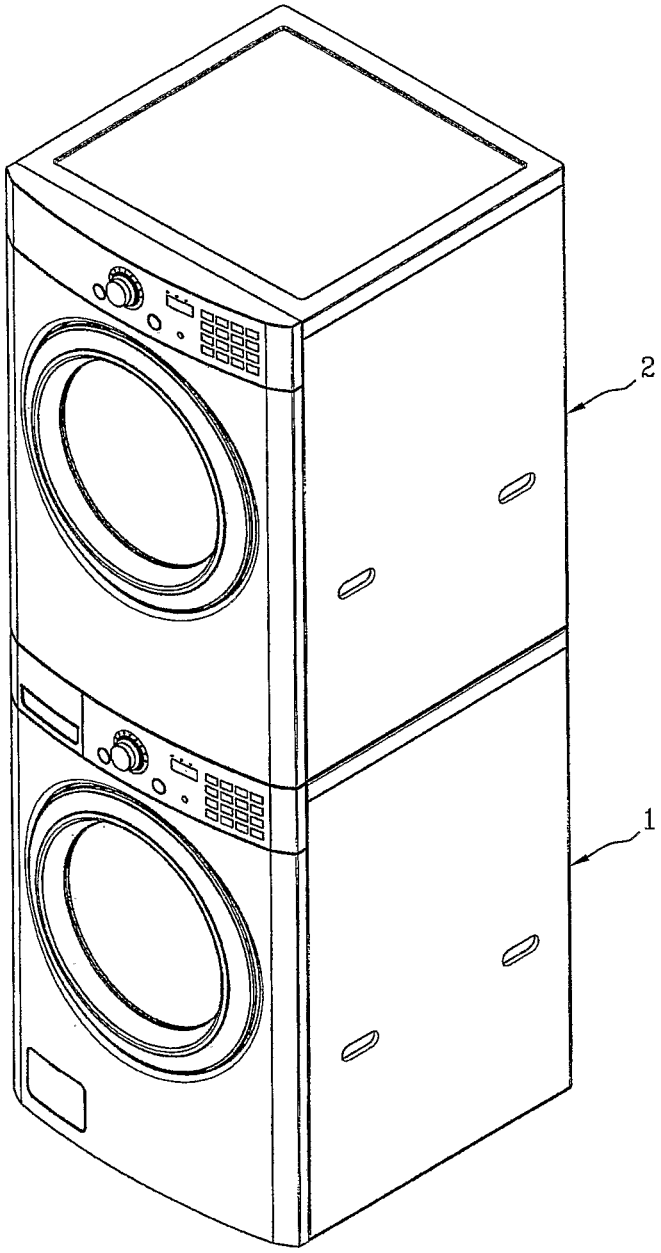
FIG. 1 illustrates a perspective view of two kinds of related art laundry devices stacked.
Figure 2:
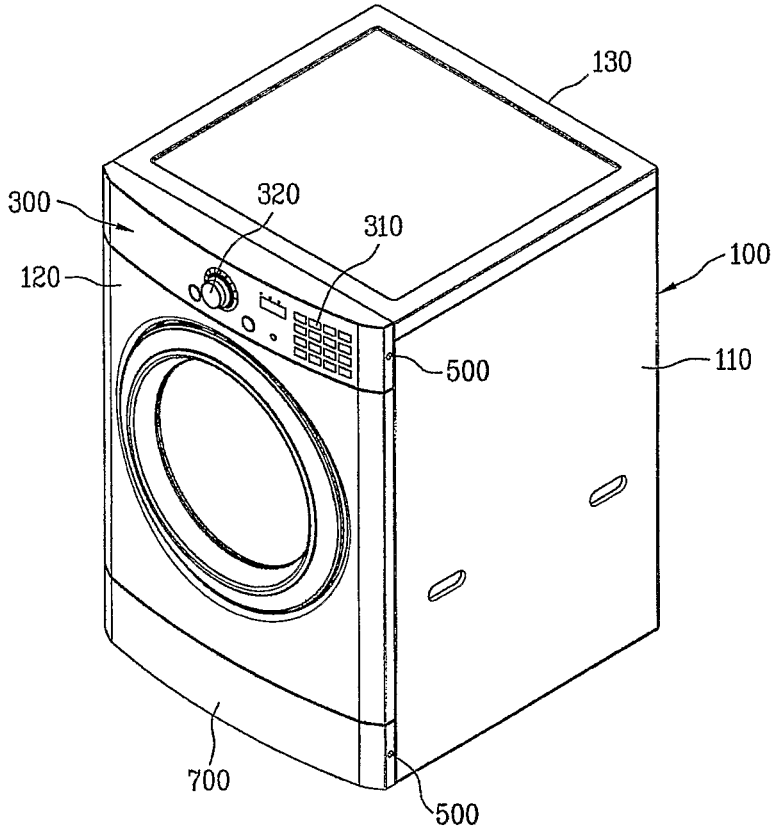
FIG. 2 illustrates a perspective view of a laundry device in accordance with a preferred embodiment of the present invention.
Figure 3:
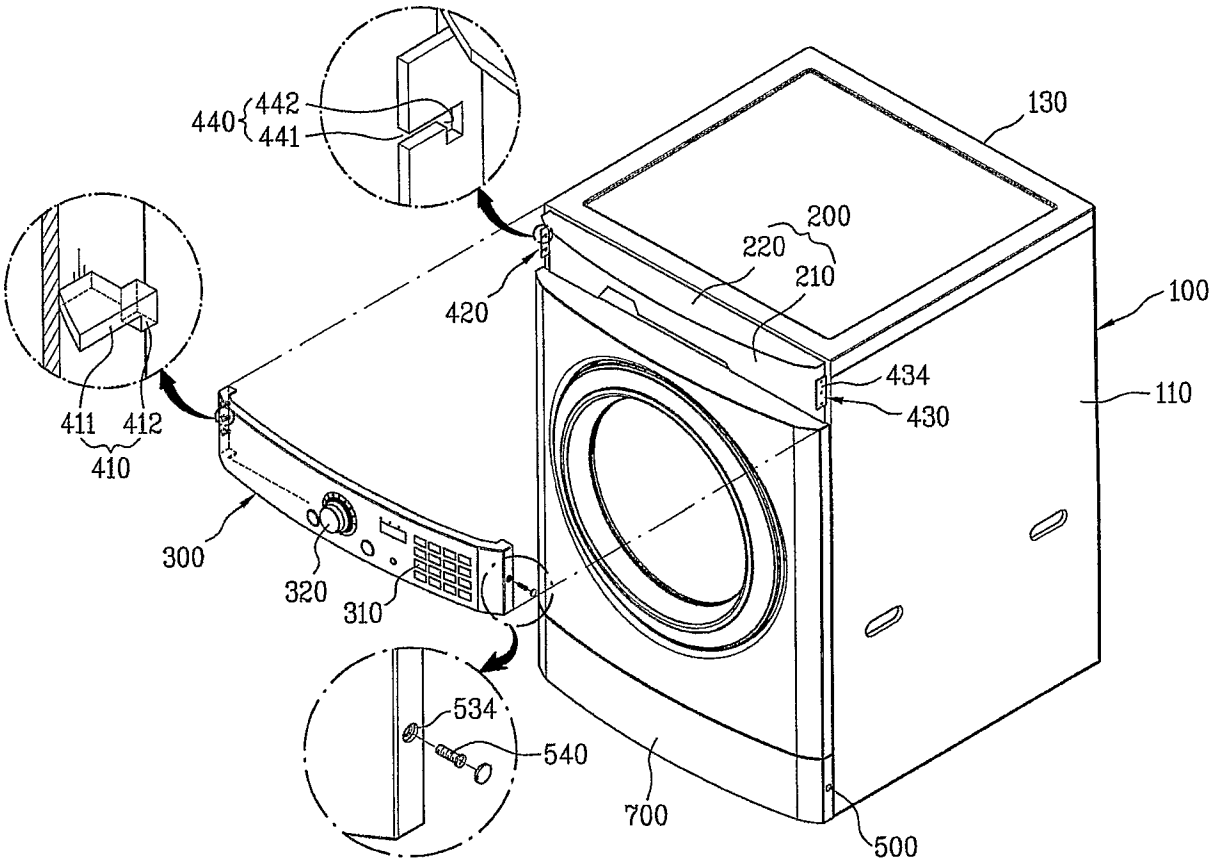
FIG. 3 illustrates a perspective view of a laundry device in accordance with a preferred embodiment of the present invention, with enlarged perspective views of key parts for illustrating a panel frame mounted on an upper portion of a body case, and a control panel which is being mounted on the panel frame.

Referring to FIGS. 2 and 3, the laundry device includes a body case 100, a panel frame 200, a control panel 300, and a falling off preventive portion.

At first, the body case 100 will be described.

The body case 100 includes a cabinet 110 on both sides thereof, a cover cabinet 120 which forms a front thereof, and a top plate 130 which forms a top thereof.

The body case 100 has opened upper and lower front portions.

The panel frame 200 will be described.

Referring to FIG. 3, the panel frame 200 which is a portion for mounting the control panel 300 thereon is mounted on the opened upper portion of the front of the body case 100.

The panel frame 200 includes a body 210 for closing the opened upper portion of the front of the body case 100, and an upper side portion 220 curved forward along an upper circumference of the body 210 and secured to an inside upper surface of the control panel 300.

In the embodiment, the panel frame (hereafter, "a lower panel frame") (not shown) is also mounted on the opened lower portion of the body case 100 (a lower side of the cover cabinet).

The lower panel frame is provided for secured mounting of the control panel 300 on the lower portion of the front of the body case 100, and cutting off heat or moisture from the body case 100 from entering into the control panel 300.

The control panel 300 will be described.

The control panel 300 is a unit for making various control required for operation.

Referring to FIGS. 2 and 3, the control panel 300 is designed so to be mounted on the front of the panel frame 200, or a front of the lower panel frame, while surrounding all circumference of the panel frame 200.

The control panel 300 also has a front with a plurality of selection buttons 310, and operation dials 320 provided thereon, and a back with a circuit board (not shown) mounted thereon.

The falling off preventive portion will be described.

The falling off preventive portion is provided for fastening the control panel 300 to the panel frame 200, and preventing the control panel 300 from falling off the panel frame 200 in a front side thereof.

The falling off preventive portion is formed such that one side of the panel frame 200 is matched with one side of the control panel 300.

Referring to FIG. 3, the first preferred embodiment of the present invention suggests the falling off preventive portion to include a projection 410 from the control panel 300, and brackets 420 and 430, and a slot 440.

The projection 410 is formed on opposite sides of a back side of the control panel 300.

The projection 410 includes a supporting end 411 formed as one unit with the control panel 300, and a bent end 412 bent downward (or upward) from an inside end of the supporting end 411.

The supporting end 411 is constructed of a thin plate, with a front formed as one unit with a back of the control panel 300, and a side formed as one unit with an inside wall of a side of the control panel 300.

The brackets 420, and 430 are projected forward from opposite sides of the panel frame 200, and the slot 440 is formed in the bracket 420 (hereafter, a first bracket) on a side opposite to the projection 410 from the control panel 300.

The slot 440 is cut to an end of the first bracket 420.

The slot 440 includes a horizontal entrance 441 for inserting the supporting end 411 of the projection 410, and a vertical entrance 442 for inserting the bent end 412 of the projection 410.

The slot 440 has a width enough to make smooth insertion of the supporting end 411 therein.

Particularly, it is preferable that the projection 410 and the slot 440 are formed at numbers at least two equal to each other.

The bracket 430 (hereafter called as second bracket) without the slot 440 and a side of the control panel opposite thereto are also provided with moving preventive portions for preventing the control panel 300 from moving in both directions.

Though there may be a plurality of kinds of the moving preventive portion, the first preferred embodiment of the present invention suggests a screw 540 for fastening the side of the control panel 300 to the second bracket 430.

Figure 20:
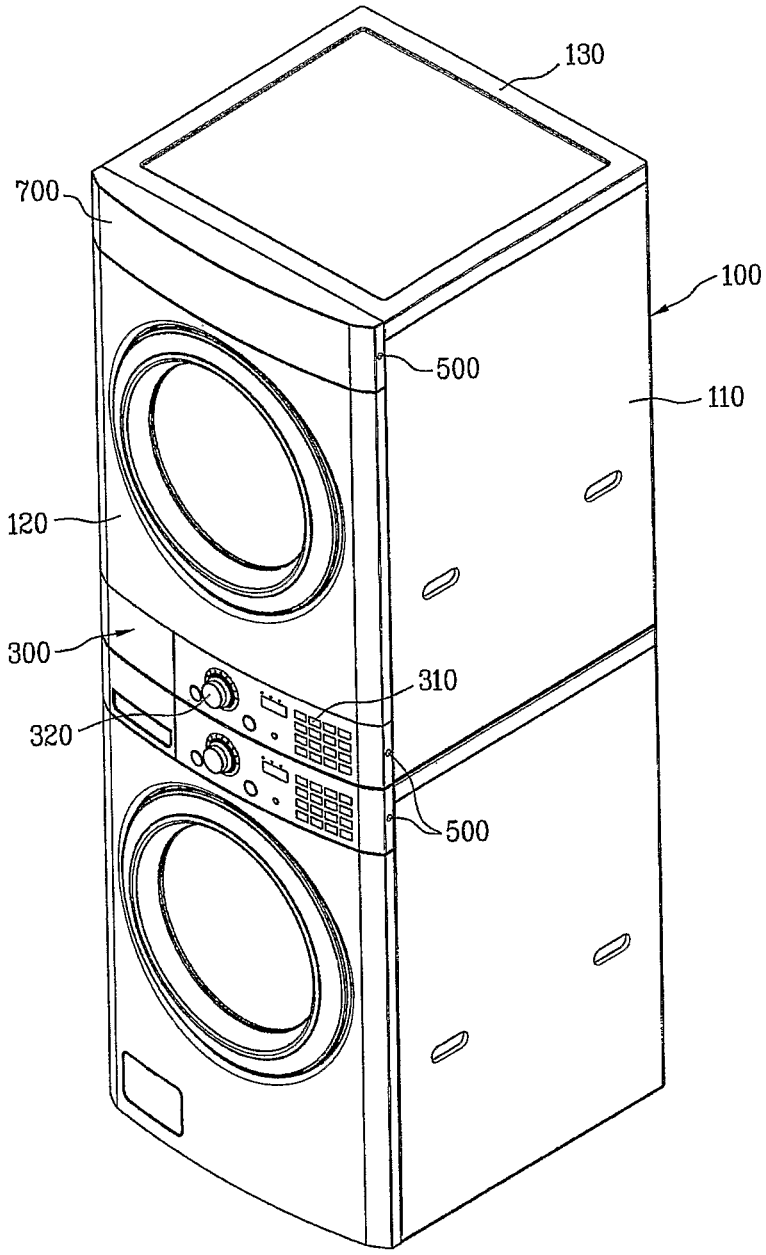
FIG. 20 illustrates a perspective view a laundry device in accordance with a preferred embodiment of the present invention stacked on another laundry device.

In the meantime, referring to FIGS. 3 and 20, the first preferred embodiment of the present invention suggests including a cover panel 700 further.

The cover panel 700 is mounted on a front of the other panel frame in a case the control panel 300 is mounted on any one of the panel frame 200 and the lower panel frame (not shown).

It is preferable that the cover panel 700 has a shape identical to the control panel 300, and is fastened to the control panel 300 in a fashion identical to the control panel 300, but without the selection buttons 310, the operation dials 320, and the circuit board (not shown).

Of course, the cover panel 700 may have the selection buttons 310, the operation dials 320, and the circuit board (not shown) provided thereto, and other ornamental design (for an example, trade mark) printed thereon.

The cover panel 700 prevents a portion, the control panel is mounted thereon, from exposing to an outside of the laundry device, thereby preventing complaint of the user.

The steps of mounting the control panel 300 to the panel frame 200 in the laundry device of the embodiment of the present invention will be described with reference to FIGS. 4 and 5.

After putting the control panel 300 close to the panel frame 200 such that an inside wall of the side of the control panel 300 having the projection 410 formed thereon is enough to be in contact with an outside wall of the first bracket 420 of the panel frame 200, the control panel 300 is pushed toward the panel frame 200.

Figure 4:
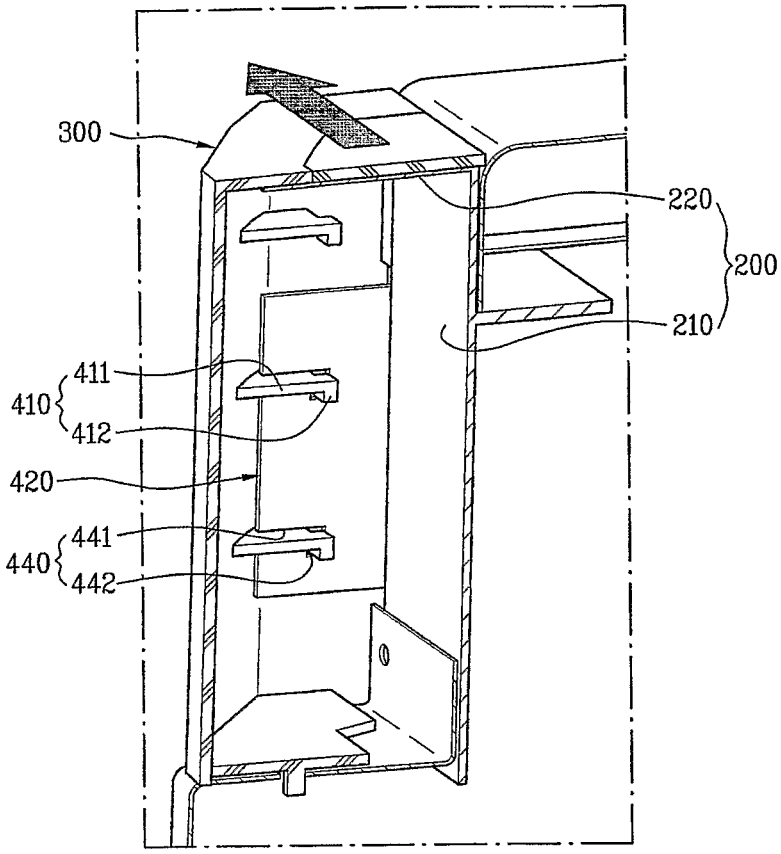
FIGS. 4 and 5 illustrate enlarged perspective views of key parts for illustrating the steps of mounting/dismounting a control panel on/from a panel frame of a laundry device in accordance with a preferred embodiment of the present invention.

In this case, referring to FIG. 4, the supporting end 411 of the projection 410 is placed in the horizontal entrance 441 of the slot 440 in the first bracket 420.

In this instance, the bent end 412 of the projection 410 is spaced from the vertical entrance 442 of the slot 440, allowing the control panel 300 to move in a front/rear direction, freely.

In above state, the control panel 300 is moved (in a left direction in the drawing) so that the bent end 412 can be positioned in the vertical entrance 442.

Figure 5:
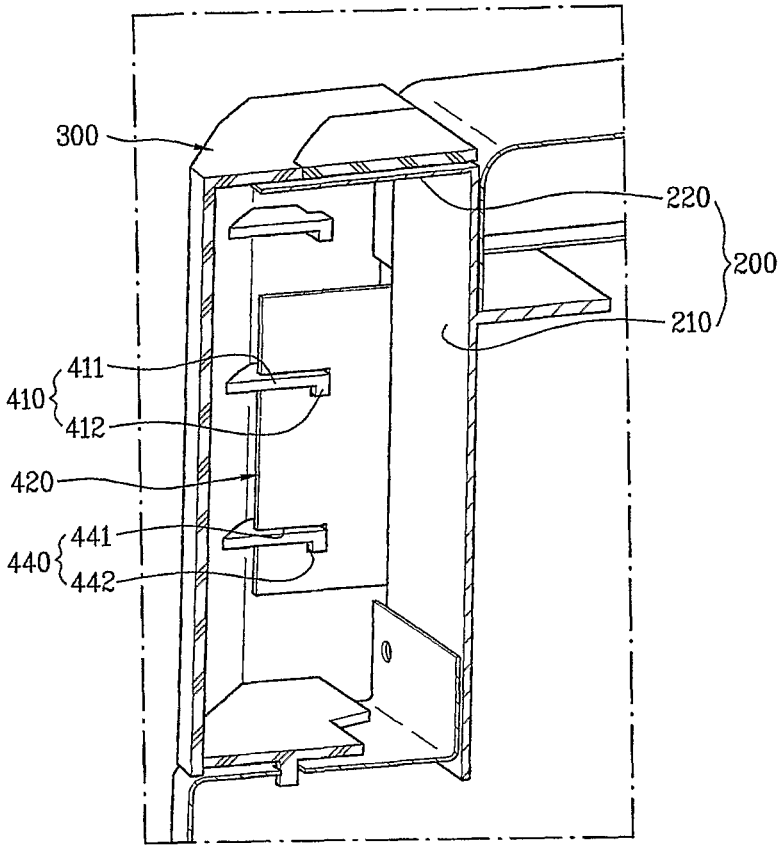

In this case, referring to FIG. 5, the bent end 412 on the control panel 300 is positioned within the vertical entrance 442 in the first bracket 420.

According to this, the control panel 300 is brought into a position where the control panel 300 is unable to move toward the front of the panel frame 200.

Moreover, in this case, an inside wall surface of an opposite side (right side in the drawing) of the control panel 300 is in close contact with the outside wall surface of the second bracket 430.

Then, by fastening the right side of the control panel 300 to the second bracket 430 with a screw 540, movement of the control panel 300 in both directions is prevented.

Next, the steps of making selective change of a mounting position of the control panel 300 according on an arrangement of the laundry devices in accordance with a first preferred embodiment of the present invention will be described in more detail.

If the laundry device is arranged on one side of another laundry device, or used singly, the control panel 300 is mounted to an upper portion of a front of the body case 100 as shown in FIG. 2 attached hereto.

In this instance, the cover panel 700 is mounted to a front of a lower panel frame (not shown) which is a lower portion of a front of the body case 100.

However, if the laundry device is stacked on another laundry device, it is preferable that the control panel 300 is mounted to the lower portion of the front of the body case 100 as shown in FIG. 20 attached hereto.

For this, the control panel 300 is detached from the panel frame 200 at the upper portion of the front of the body case 100.

The steps of detaching the control panel 300 is progressed in reverse order of a series of steps of attaching the control panel 300 to the panel frame 200, which will be described in detail.

At first, the screw 540 is removed from a right side of the control panel 300, to free the right side of the control panel 300 from the second bracket 430.

In this state, the control panel 300 is moved to right in the drawing.

In this case, the control panel 300 at the right side thereof becomes spaced from the second bracket 430, and the bent portion 412 of the projection 410 thereof comes out of the vertical entrance 442 of the slot 440 in the first bracket 420.

Accordingly, the control panel 300 becomes free from the first bracket 420 and the second bracket 430, and, if the control panel 300 is taken out in a front direction, the control panel 300 can be removed, fully.

Once the removal of the control panel 300 is finished, the cover panel 700 is removed from the lower panel frame (not shown).

In this instance, a series of steps for removing the cover panel 700 from the lower panel frame is identical to a series of steps for removing the control panel 300 from the panel frame 200.

Of course, the steps for removing the cover panel 700 from the lower panel frame may be carried out before the steps for removing the control panel 300 from the panel frame 200.

Thus, upon finishing the removal of the control panel 300 and the cover panel 700, the control panel 300 is mounted to a front of the lower panel frame, and the cover panel 700 is mounted to a front of the panel frame 200.

A series of steps of fastening the control panel 300 to the lower panel frame, and a series of steps of fastening the cover panel 700 to the panel frame 200 are the same with descriptions already made.

Particularly, it is preferable that, before fastening the control panel 300 to the lower panel frame, various electric cables connected to the circuit board (not shown) are connected to various power sources, and signal connection terminals in the body case 100.

At the end, by above series of steps, the control panel 300 is positioned at a lower side of the front of the body case 100, a position the user can operate conveniently even if the laundry device is positioned high compared to a height of the user.

If it is intended to arrange the laundry device separately, or on a side of another laundry device, the control panel 300 may be mounted to the panel frame 200 in an order in reverse of the foregoing series of steps (the series of steps for mounting the control panel to the lower panel frame).

In the meantime, it is not true that the falling off preventive portion in the laundry device of the present invention can be formed only with the foregoing embodiment.

For an example, the projection 410 of the falling off preventive portion may be formed at the panel frame 200, and the slot 440 may be formed in the control panel 300.

A laundry device in accordance with a second preferred embodiment of the present invention will be described.

In the meantime, parts of the second embodiment identical to the first embodiment will be given reference numerals the same with the first embodiment, and detailed description of parts of the second embodiment already described in detail in the first embodiment will be omitted.

Figure 6:
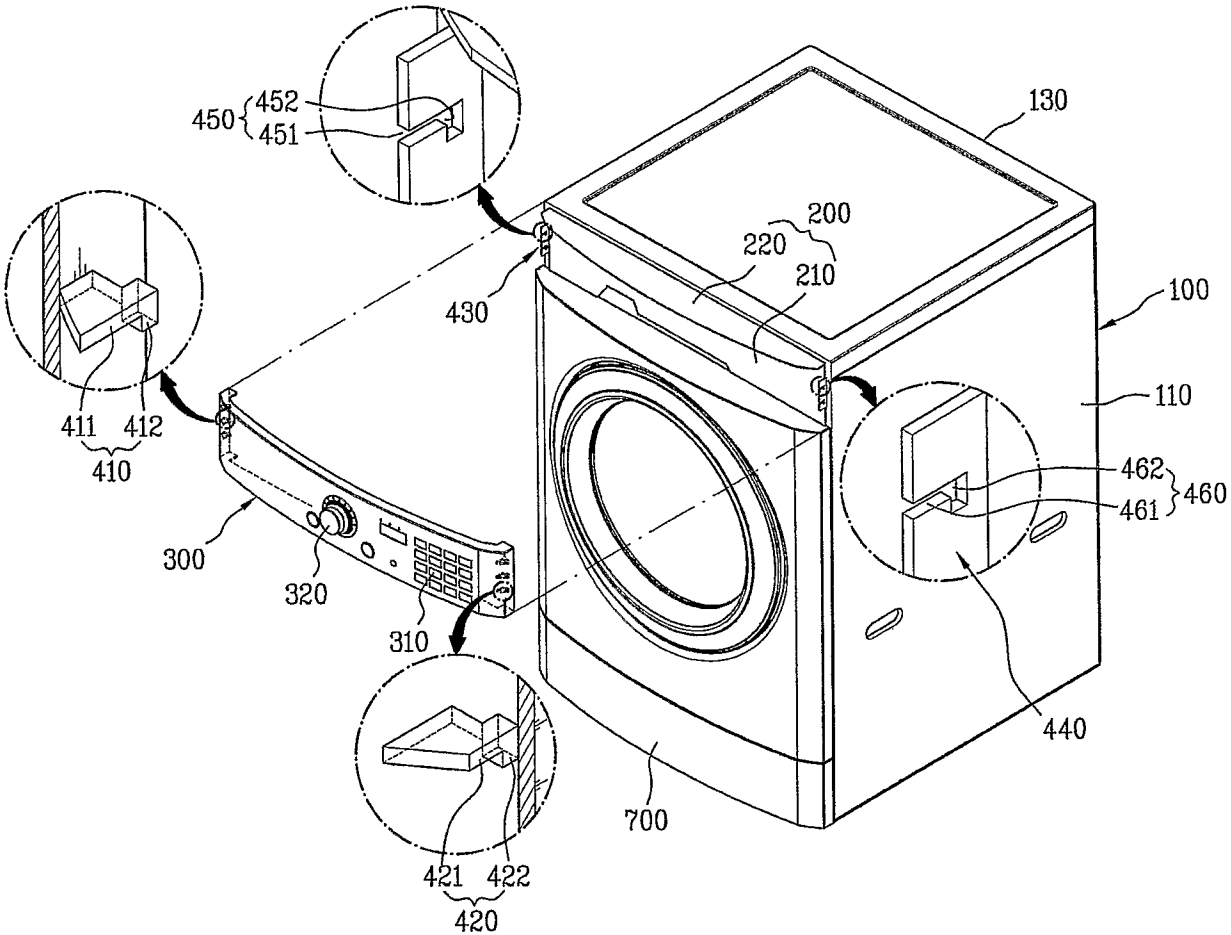
FIG. 6 illustrates a perspective view of a laundry device in accordance with a preferred embodiment of the present invention, with enlarged perspective views of key parts for illustrating a panel frame mounted on an upper portion of a body case, and a control panel which is being mounted on the panel frame.

FIG. 6 illustrates the laundry device in accordance with a second preferred embodiment of the present invention, having falling off preventive portions provided both to a control panel 300 and a panel frame 200.

That is, in this case too, the falling off preventive portion is designed to fasten the control panel 300 to the panel frame 200, and prevent the control panel 300 from falling off the panel frame 200 in a front side thereof.

In this case too, alike the first embodiment, the falling off preventive portions are formed at opposite ends of the panel frame 200, and opposite insides of the control panel 300 in conformity with each other, such that movement of the control panel 300 in either direction causes the control panel to be aligned, and fastened to/spaced, and detached from the panel frame 200.

Referring to FIG. 3, the falling off preventive portion in accordance with a second preferred embodiment of the present invention includes projections 410, and 420 on opposite sides of an inside of the control panel 300, one pair of brackets 430 and 440 at opposite ends of the panel frame 200, and slots 450 and 460 formed so as to match with the projections 410 and 420.

Referring to FIG. 6, the projection 410 and 420 includes a first projection 410 on a right side of a back of the control panel 300, and a second projection 420 on a left side of the back of the control panel 300.

The projection 410 or 420 includes a supporting end 411 or 421, and a bent end 412 or 422 bent downward (or upward) from one side end of the supporting end 411 or 421.

The supporting end 411 or 421 is constructed of a thin plate, and has a front formed as one body with a back of the control panel 300, and a side formed as one body with an inside of a side of the control panel 300.

The brackets 430 and 440 are projected forward from opposite sides of the panel frame 200, respectively.

Referring to FIG. 3, the brackets 430 and 440 are a first bracket 430 on a left side of the panel frame 200, and a second bracket 440 on a right side of the panel frame 200, when seen from the front the laundry device.

The slots 450 and 460 are formed in the brackets 430 and 440 respectively, including a first slot 450 in the first bracket 430, and a second slot 460 in the second bracket 440.

The first slot 450 extends to an edge of the first bracket 430, and includes a horizontal slot 451 for placing the supporting end 411 of the first projection 410 therein, and a vertical slot 452 for placing the bent end 412 of the first projection 410 therein.

The second slot 460 extends to an edge of the second bracket 430, and includes a horizontal slot 461 for placing the supporting end 421 of the second projection 420 therein, and a vertical slot 462 for placing the bent end 422 of the second projection 420 therein.

The slot 450 or 460 has a width enough to permit smooth insertion of the supporting end 411 or 421.

It is preferable that more than two of the projections 410 and 420 and the slots 450 and 460 are formed at equal numbers.

In the meantime, alike the first embodiment of the present invention, the laundry device in accordance with a second preferred embodiment of the present invention also includes a cover panel 700.

The steps of mounting the control panel 300 to the panel frame 200 of the laundry device in accordance with preferred embodiment of the present invention will be described with reference to FIGS. 7 to 10.

At first, after putting an inside wall of the first projection 410 of the control panel 300 close to an outside wall of the first bracket 430 of the panel frame 200 in an extent the inside wall is in contact with the outside wall, the control panel 300 is pushed toward the panel frame 200.

Figure 7:
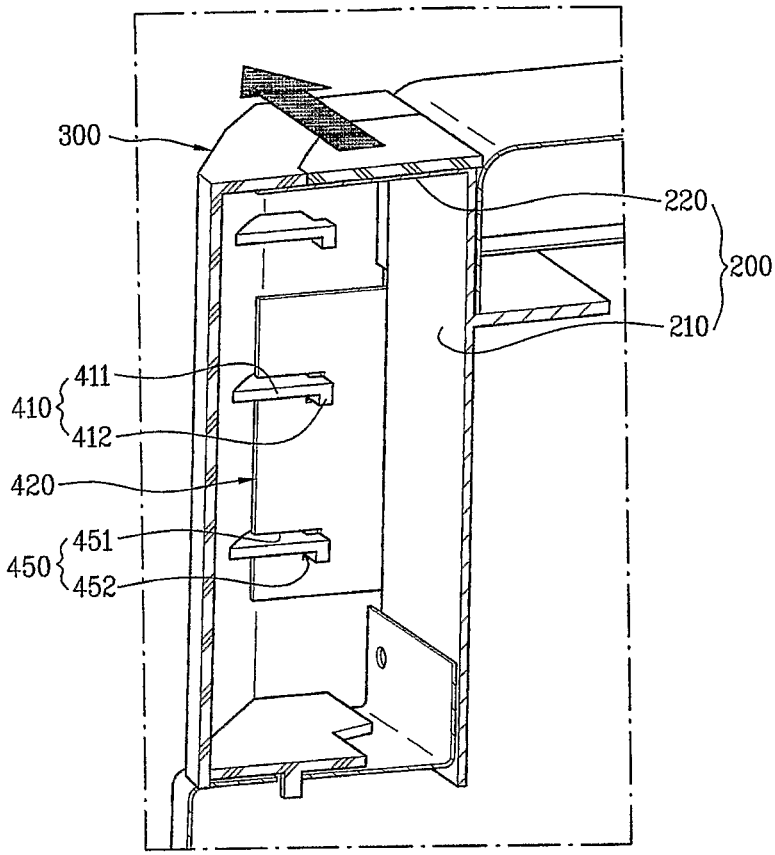
FIGS. 7 and 8 illustrate enlarged perspective views of key parts for illustrating the steps of mounting/dismounting a control panel on/from a panel frame of a laundry device in accordance with a preferred embodiment of the present invention.
Figure 9:
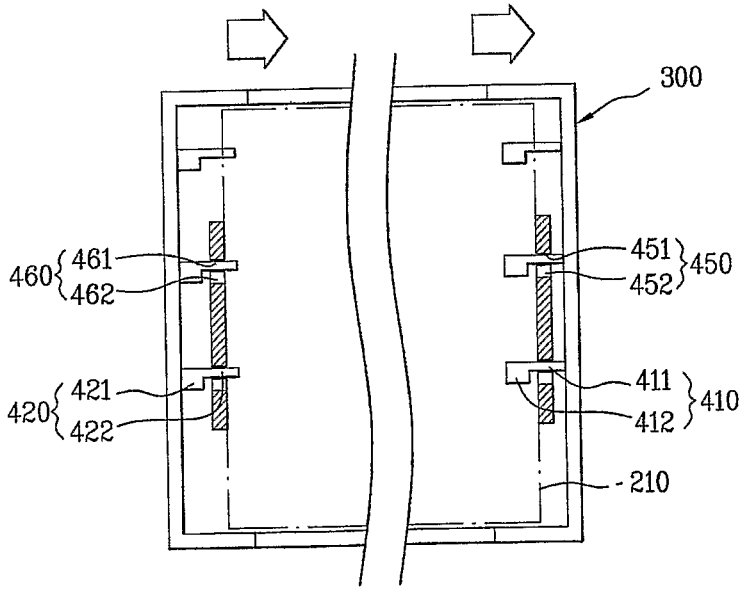
FIGS. 9 and 10 illustrate back views of a control panel for illustrating the steps of mounting/dismounting a control panel on/from a panel frame of a laundry device in accordance with a preferred embodiment of the present invention.

In this case, referring to FIGS. 7 and 9, the supporting end 411 of the first projection 410 is placed in the horizontal slot 451 in the first slot 450, and the supporting end 421 of the second projection 420 is placed in the horizontal slot 461 in the second bracket 440.

In this instance, the bent end 412 of the first projection 410 is spaced from the vertical slot 452 in the first slot 450, and the bent end 422 of the second projection 420 is spaced from the vertical slot 462 in the second slot 460, thereby allowing the control panel 300 to move in front/rear directions, freely.

Then, in above state, the control panel 300 is moved in an arrow direction (a left direction) in FIG. 7.

Figure 8:
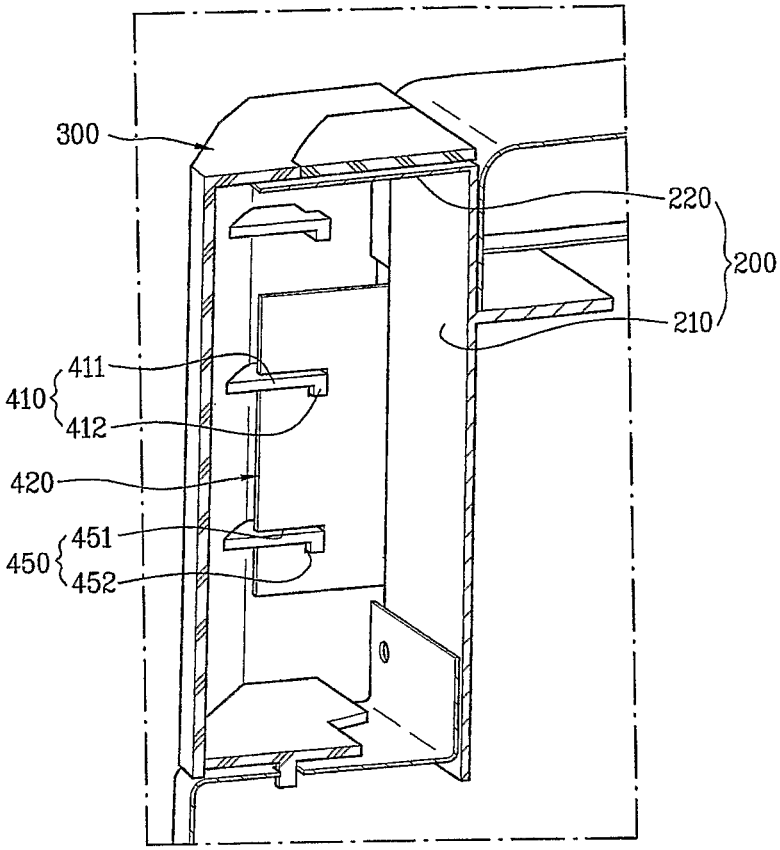
Figure 10:
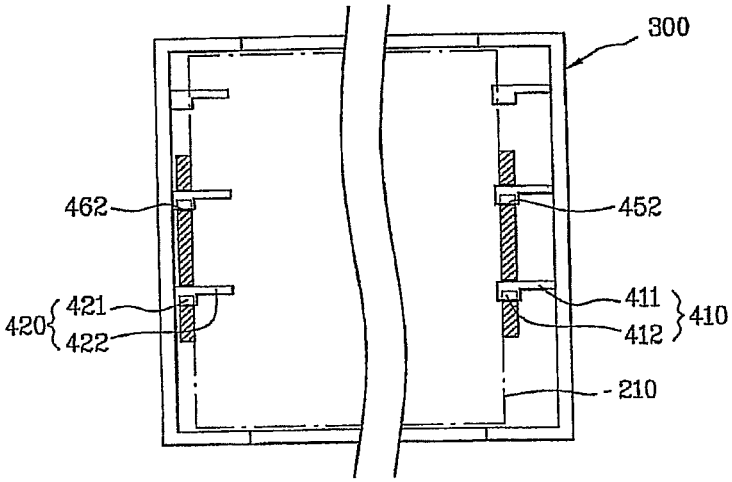

In this case, referring to FIGS. 8 and 10, the bent end 412 of the first projection 410 is placed in the vertical slot 452 of the first slot 450, and the bent end 422 of the second projection 420 is placed in the vertical slot 462 of the second slot 460.

According to this, the control panel 300 becomes immovable in a front direction of the panel frame 200, thereby finishing mounting of the control panel 300.

Next, the steps for selective change of a mounting position of the control panel 300 according to arrangement of the foregoing laundry devices in accordance with a preferred embodiment of the present invention will be described in detail.

Referring to FIG. 2, if the laundry device is installed side by side with other laundry device, or installed singly, the control panel 300 is mounted to the upper portion of the front of the body case 100.

In this instance, the cover panel 700 is mounted on the front of the lower panel frame (not shown) which is the lower portion of the front of the body case 100.

In this instance, the steps of removing the control panel 300 is carried out in reverse of a series of steps for mounting the control panel 300 to the panel frame 200, which will be described in more detail.

In a state of FIG. 10 attached hereto, the control panel 300 is moved in a left direction in the drawing (a right direction in the drawing if seen in FIG. 7).

In this case, the bent end 412 of the first projection of the control panel 300 moves out of the vertical slot 452 of the first slot 450, and the bent end 422 of the second projection 420 moves out of the vertical slot 462 of the second slot 460.

Above state is shown in FIG. 9.

According to this, the control panel 300 becomes free from the first bracket 430 and the second bracket 440. The removal of the control panel 300 is finished if the control panel 300 is pulled forward.

Upon finishing the removal of the control panel 300 thus, the cover panel 700 is removed from the lower panel frame (not shown).

A series of steps for removing the cover panel 700 from the lower panel frame is the same with the series of steps for removing the control panel 300 from the panel frame 200 described before.

Of course, the steps for removing the cover panel 700 from the lower panel frame may be performed before the steps for removing the control panel 300 from the panel frame 200.

Upon finishing removal of the control panel 300 and the cover panel 700, the control panel 300 is mounted to the front of the lower panel frame, and the cover panel 700 is mounted to the front of the panel frame 200.

Series of steps for mounting the control panel 300 to the lower panel frame and mounting the cover panel 700 to the panel frame 200 are the same with description made before.

In the meantime, though not shown, different from the first or second embodiment of the present invention, after forming projections on a back of one side of the control panel, and, in correspondence to the projections, forming brackets having slots in one side of the panel frame for placing the projections in the slots when the control panel is moved from one side to the other side in front of the panel frame, the other side of the control panel may be fastened to the panel frame with a screw, to mount the control panel to the panel frame.

In the meantime, as a moving preventive member for rigidly fastening the control panel to the panel frame, FIG. 3 which illustrates a laundry device in accordance with a first preferred embodiment of the present invention shows application of a screw.

It is apparent that a structure in which the control panel is fastened to the panel frame with the screw is applicable to the laundry device in accordance with a second preferred embodiment of the present invention.

In the meantime, referring to FIGS. 3, and 11 to 19, it is preferable that the screw which is the moving preventive member is covered with a hiding cap for hiding the screw from an outside, in view of making a good looking laundry device.

Variations of the hiding cap for hiding the screw used as the moving preventive member that fastens the control panel to the panel frame in foregoing embodiments of the present invention will be described.

Figure 11:
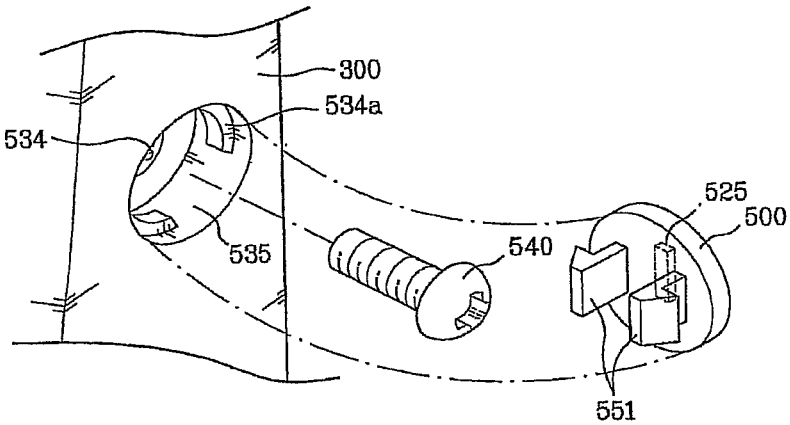
FIGS. 11 and 12 illustrate an exploded perspective view and a section each showing a hiding cap in accordance with a first preferred embodiment of the present invention for hiding moving preventive portion in a laundry device of the present invention.
Figure 12:
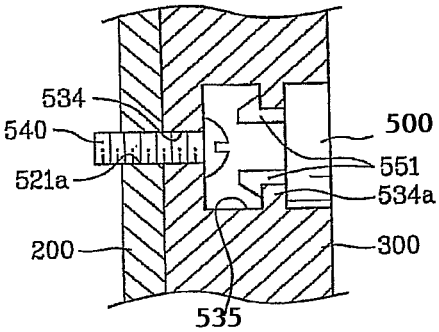

As a first variation of the hiding cap for hiding the screw will be described with reference to FIGS. 11 and 12.

Also, the first variation of the hiding cap will be described with reference to FIG. 3 which illustrates a laundry device in accordance with a first preferred embodiment of the present invention.

Referring to FIG. 3, the panel frame 200 has a vertical bracket 430 on one side projected forward with a first hole 434 formed therein.

As a position opposite to the first hole 434, the control panel 300 has a second hole 534 on one side.

In the meantime, around the second hole 534, there is a recess 535 for placing the hiding cap 500 therein.

Formed on an inside circumference of the recess 535, there is a holding step 534*a*.

It is preferable that the holding step 534*a* is formed only at a portion of the inside circumference of the recess 535.

This is for selective holding of a holding hook 551 on the hiding cap 500 when the holding hook 551 circles round the inside circumference of the recess 535.

The second hole 534 and the recess 535 can be formed in both sides of the control panel 300, and it is preferable that the second hole 534 is a threaded hole for fastening a screw.

This is for firmer screw fastening of the control panel 300 to the bracket 430 on the panel frame 200.

The moving preventive member 540 serves to fasten the control panel 300 to the bracket 430 on the panel frame 200.

The moving preventive member 540 is a bolt or screw for passing through, and thread fastening the second hole 534 in the control panel 300 and the first hole 434 in the bracket 430.

The hiding cap 500 prevents the screw 540 from exposing to an outside of the laundry device in a state the screw 540 fastens the control panel 300 to the bracket 430.

It is preferable that the hiding cap 500 has a holding hook 551 for holding the holding step 534*a* on the inside circumference of the recess 535.

This is for preventing the hiding cap 500 from falling off the recess 535 easily when the hiding cap 500 is mounted in the recess 535 for preventing the screw 540 from exposing to an outside of the laundry device.

It is preferable that the hiding cap 500 has a holding slot 525 in a surface which is exposed to an outside of the laundry when the hiding cap 500 is mounted in the recess 535.

This is for easy rotation of the hiding cap 500 by using a rotating member, such as a coin, at the time the hiding cap 500 is rotated within the inside circumference of the recess 535 for preventing the hiding cap 500 from falling off the recess 535 after the hiding cap 500 is mounted in the recess 535.

The hiding cap 500 may be formed of rubber, resin, or metal.

A state the control panel 300 is mounted to the panel frame 200 according to the foregoing structure will be described.

At first, the second holes 534 in opposite sides of the control panel 300 are aligned with the first holes 434 in the bracket 430, respectively.

In this instance, the recess 535 around the second hole 534 is in a line with the first hole 434.

Then, by using a moving preventive member, such as a bolt or a screw, the recess 535, the second hole 534, the first hole 434 are passed through, and thread fastened.

Then, the hiding cap 500 is placed in the recess 535.

In this instance, the hiding cap 500 is inserted in the recess 535, with the holding hook 551 thereon aligned with an inside circumference having no holding step 534*a* of the recess 535 formed thereon.

Then, the rotating member, such as a coin, is inserted in the holding slot 52 in the exposed surface of the hiding cap 500, and turned a half turn.

According to this, referring to FIG. 4, as the hiding cap 500 turns, the holding hook 551 is engaged with the holding step 534*a* of the recess 535.

By this, the exposure of the shaping preventive member 40 to an outside of the laundry device is prevented.

In the meantime, it is apparent that, in order to dismount the control panel 300 from the laundry device, it is required to perform the mounting steps, reversely.

Up to now, as a first variation of the moving preventive member of the present invention, a structure is described, in which the hiding cap having the holding hooks is placed in the recess having the holding steps for preventing the moving preventive member, which fastens the control panel to the panel frame, from exposing to an outside of the laundry device.

Next, a second variation of the hiding cap for hiding the screw of the laundry device of the present invention will be described with reference to FIGS. 13 and 14.

Figure 13:
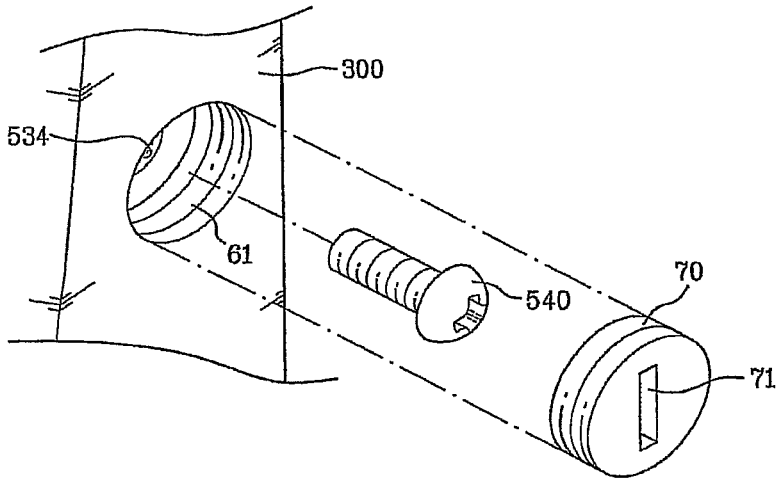
FIGS. 13 and 14 illustrate an exploded perspective view and a section each showing a hiding cap in accordance with a second preferred embodiment of the present invention for hiding moving preventive portion in a laundry device of the present invention.
Figure 14:
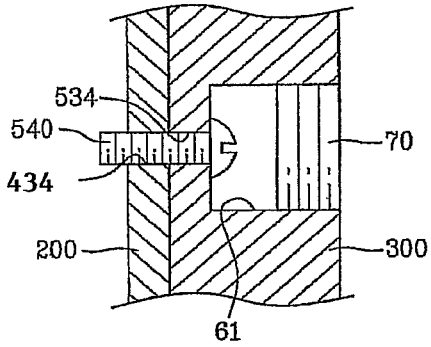

FIGS. 13 and 14 each illustrates key portions where the hiding cap is mounted to the control panel.

In the meantime, since portions excluding the control panel and the hiding cap are identical to the laundry device in accordance with the first preferred embodiment of the present invention, portions of the control panel and the hiding cap different from the first preferred embodiment and the first variation will only be described.

Referring to FIG. 3, in opposite sides of the control panel 300, there are second holes 534 identical to one variation of mounting the moving preventive member, each with a recess 61 formed around the second hole 534.

The recess 61 has a female thread in an inside circumference.

The hiding cap 70 is cylindrical, and has a male thread for fastening to the recess 61.

It is preferable that the hiding cap 70 is formed of resin or metal for forming the thread on the outside circumference.

It is preferable that the hiding cap 70 has a holding slot 71 in a surface exposed to an outside of the laundry device.

This is for easy rotation of the hiding cap 70 at the time the hiding cap 70 is rotated for screw fastening the hiding cap 70 to the recess 61.

The steps for mounting the control panel to the panel frame of the foregoing laundry device will be described.

At first, after aligning the second hole 534 in the control panel 300 to the first hole 434 in the bracket 430, the moving preventive member 40 is passed through the second hole 534 and the first hole 434.

Next, the hiding cap 70 is thread fastened to the recess 61 so that the moving preventive member 40 is not exposed to an outside of the laundry device.

In this instance, it is preferable that for easy turning of the hiding cap 70, the hiding cap 70 is turned with a rotating member, such as a coin, inserted in the holding slot 71.

Thus, mounting of the control panel 300 to the panel frame 200 of the laundry device in accordance with the embodiment of the present invention is finished.

In the meantime, FIGS. 15 to 19 illustrate third or fourth variations of the hiding cap in the laundry device in accordance with one of preferred embodiments of the present invention, for hiding a screw provided to the laundry device.

Figure 15:
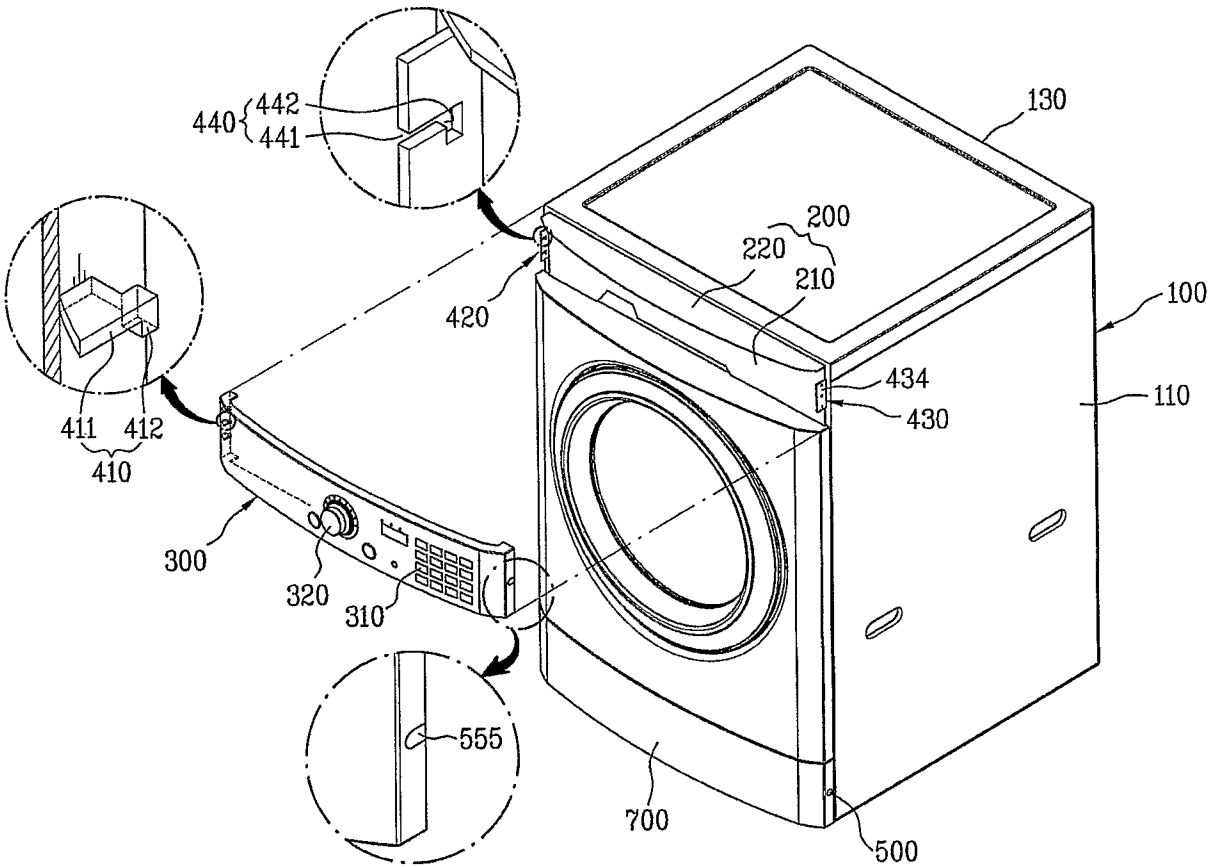
FIG. 15 illustrates a perspective view of a hiding cap in accordance with a third or fourth preferred embodiment of the present invention for hiding a moving preventive portion in a laundry device of the present invention.

At first, the moving preventive member in accordance with a third preferred embodiment of the present invention will be described, with reference to FIGS. 15 to 17.

The hiding cap in accordance with the third preferred embodiment of the present invention for hiding the moving preventive member of the laundry device includes a control panel 300 having a screw hole 88 in an inside bottom surface and a recess 380 with a sealing step 320 along an outer side of an inside wall for thread fastening the control panel 300 to the panel frame 200, and a hiding cap 555 rotatably hinged on one side of the control panel for opening/closing the recess 380.

The panel frame 200 has a frame 430 at a position opposite to the screw hole 88 in the control panel 300.

Figure 16:
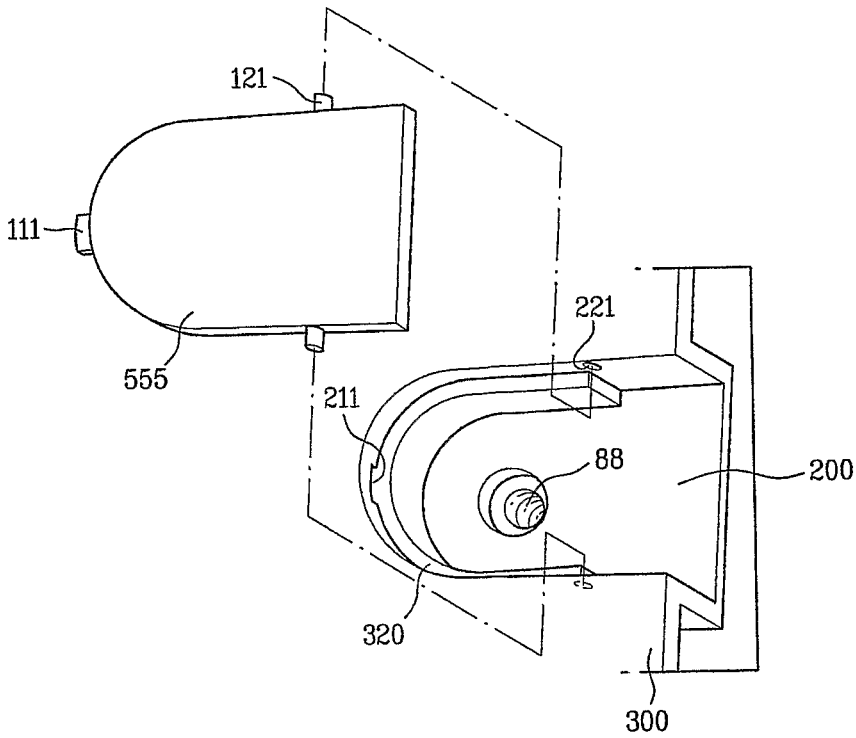
FIGS. 16 and 17 illustrate an exploded perspective view and a section each showing a hiding cap in accordance with a third preferred embodiment of the present invention for hiding moving preventive portion in a laundry device of the present invention.

The frame 430 has a first hole 434 for threading fastening the control panel 300 to the panel frame 200, and, as shown in FIG. 16, the control panel 300 also has a screw hole 88 in correspondence to the first hole 434 in the panel frame 200. In this instance, the screw hole 88 in the control panel 300 is provided to hide the screw which is the moving preventive member hidden under the hiding cap 555.

In the meantime, referring to FIG. 16 attached hereto, the control panel 300 has a recess 380 in one side of the control panel 300 with a bottom surface having a screw hole 88 formed therein.

The control panel 300 may have the recesses 380 in opposite sides with the bottom surfaces having the screw holes 88 formed therein, respectively.

The recess 380 in the control panel 300 has one pair of hinge holes 221 in a circumference, and the hiding cap 555 has hinge projections 121 matched to the hinge holes 221, respectively.

The hinge projection 121 on the hiding cap 555 is rotatable around a hinge axis of the hinge hole 221.

Though not shown, opposite to the structure in FIG. 16, it is apparent that the hinge hole (not shown) may be formed in a circumference of the hiding cap 555, and the hinge projection (not shown) may be formed in the recess 380 matched to the hinge hole.

In the meantime, referring to FIG. 16, the hiding cap 555 is provided with a holding projection 111, and the recess 380 has a holding slot 211 matched to the holding projection 111 for fastening the hiding cap 555 at the time the hiding cap 555 is opened/closed.

Though not shown, in this case too, it is apparent that, opposite to above, the holding slot may be formed in the hiding cap, and the holding projection may be formed in the recess 380 matched to the holding slot.

The operation of the hiding cap in accordance with the third preferred embodiment of the present invention for hiding the screw in the laundry device will be described with reference to drawing attached hereto.

Figure 17:
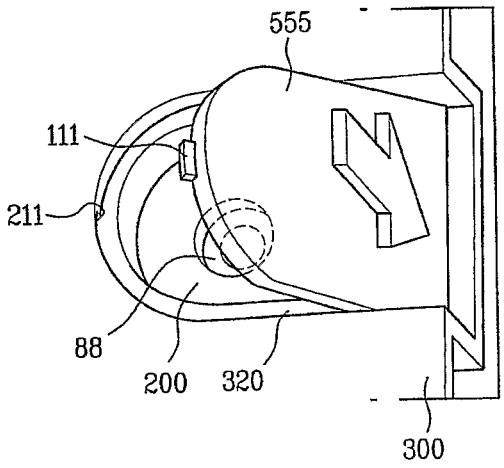

At first, the hiding cap 555 is pressed with an external force greater than a pre-determined force in a direction of an arrow in FIG. 17, so that the holding projection 111 on the hiding cap 555 moves out of the holding slot 211.

According to this, the hiding cap 555 becomes rotatable around the hinge axis of the hinge projection 121. As the hiding cap 555 rotates, an inside of the recess 380 is exposed.

That is, if it is in a state the control panel 300 is mounted to the panel frame 200 with the screw which is the moving preventive member, the screw hole 88 in the exposed recess 380 is in a state the screw is fastened to the screw hole 88.

For reference, FIGS. 16 and 17 illustrate a structure of the recess 380 in the control panel 300 having no screw fastened thereto.

In the meantime, if it is in a state that the control panel is mounted to the panel frame with the screw, if the screw is turned with a tool, such as a driver, to take out the screw, the control panel can be separated from the panel frame.

At the time of separation of the control panel, the hiding cap 555 is not necessary to safekeeping because the hiding cap 555 maintains a state hinged on the control panel 300. In a case the control panel 300 is mounted to the panel frame 200 with the screw again later, by closing the hiding cap 555 such that the holding projection 111 on the hiding cap 555 is held at the holding slot 211, the recess 380 becomes invisible from an outside of the laundry device.

Figure 18:
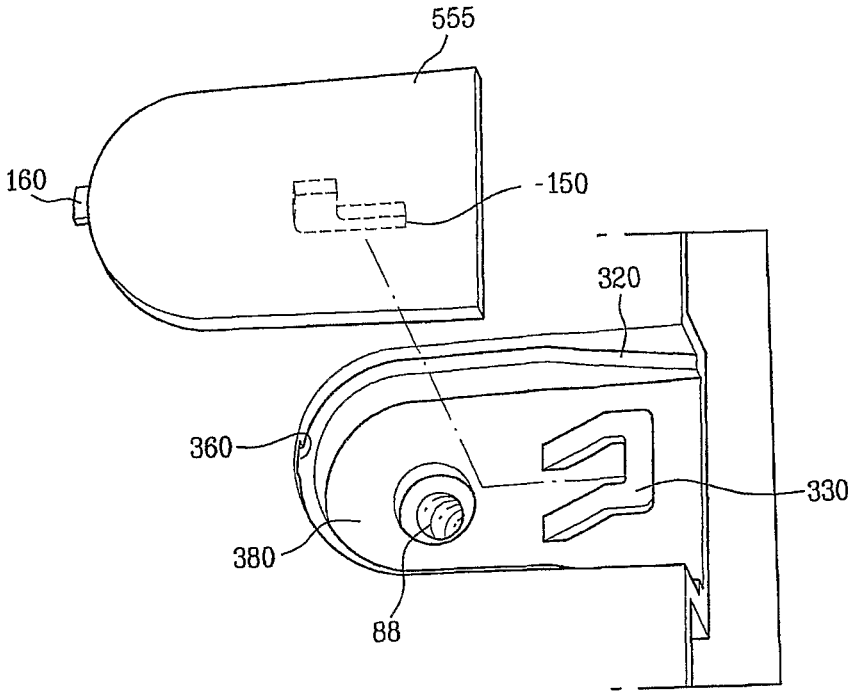
FIGS. 18 and 19 illustrate an exploded perspective view and a section each showing a hiding cap in accordance with a fourth preferred embodiment of the present invention for hiding moving preventive portion in a laundry device of the present invention.
Figure 19:
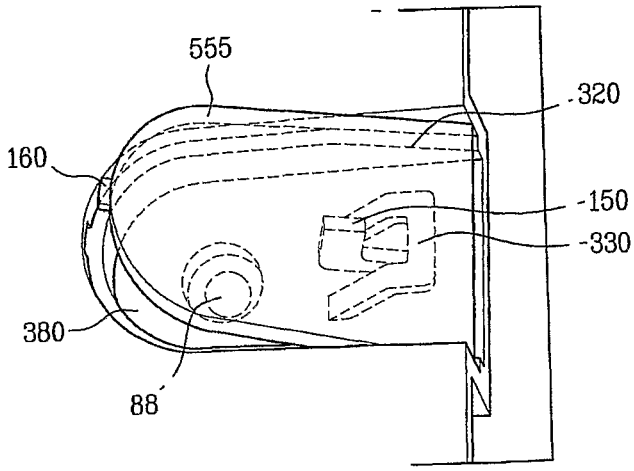

In the meantime, FIGS. 18 and 19 each illustrates a fourth variation of a hiding cap for hiding a screw in a laundry device in accordance with embodiments of the present invention.

At first, referring to FIG. 18 attached hereto, the recess 380 in the control panel 300 has a holding hook 150, and the hiding cap 555 has an eye 330 for rotatably holding the holding hook 150.

In this instance, the recess 380 has a seating step 320 on a circumference of the recess 380 for holding the hiding cap. The seating step 320 has an inward slope of a predetermined angle at a portion for guiding rotation of the hiding cap 555 at the time the hiding cap 555 is opened/closed.

The hiding cap 555 has a holding projection 160, and the recess 300 has a holding slot 360 matched to the holding projection 160.

In the meantime, in this case too, though not shown specifically, it is apparent that the holding slot may be formed in the hiding cap 555, and the holding projection may be formed on the recess 380 matched to the holding slot.

The operation of the fourth variation of the hiding cap for hiding the screw in a laundry device in accordance with preferred embodiments of the present invention will be described.

Referring to FIG. 19 attached hereto, because the holding hook 150 is held by the eye 330, upon pressing a portion opposite to a side having the holding projection 160 of the hiding cap 555 formed thereon, the hiding cap rotates around a portion the slope of the seating step 320 starts therefrom.

That is, the hiding cap 555 rotates such that the hiding cap 555 seats on the slope of the seating step 320 around a circumference of the recess 300 formed to seat the hiding cap 555.

Then, as the holding hook 150 moves backward by a predetermined distance along the eye 330 while the holding hook 150 maintains a state held by the eye 330, the recess 300 is opened.

In this case too, alike the first embodiment, in a case the screw is removed from the exposed recess and is screwed thereto again, it is possible that the screw and the recess are invisible, and loss of the hiding cap can be prevented.

Since the hiding cap is inseparably mounted to the control panel, the control panel having the foregoing hiding cap structure permits to reduce a hazard of loss of the hiding cap even if the cap is not stored separately at the time of separation of the control panel from the laundry device.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

As has been described, the laundry device in accordance with anyone of embodiments of the present invention permits the user to operate the laundry device conveniently regardless of arrangement of the laundry device by making a position of the control panel to be changed according to arrangement of the laundry device, freely.

Particularly, the laundry device in accordance with anyone of embodiments of the present invention permits the control panel safe from heat or moisture from an inside of the laundry device by providing a panel frame and a lower panel frame to positions the control panel is mounted.

Moreover, the laundry device in accordance with anyone of embodiments of the present invention permits to prevent user's inconvenience coming from position change of the control panel because the lower panel frame can be mounted to the body case, easily and securely.

Moreover, the invisibility of the screw fastened for mounting the control panel to the body makes an exterior of the laundry device clean.

The hiding cap formed to hide the screw inseparable from one side of the control panel permits a hazard of loss of the hiding cap at the time of mounting/dismounting of the control panel.

The possibility of selective mounting of the control panel to an upper portion or a lower portion of the body case for convenience of operation of the control panel at the time the laundry devices are stacked permits convenient use of the laundry devices.

The invention claimed is:

1. A laundry device, comprising:

a body case that forms an exterior of the laundry device;

a panel frame mounted to an upper end or a lower end of a front of the body case, wherein the panel frame includes a first bracket that projects forward from a first side of the panel frame, the first bracket having a hole formed therein;

a control panel detachably mounted to a front of the panel frame, wherein two opposite side ends of the control panel form bent ends that surround a front of the panel frame, the control panel including a recess and a screw hole, wherein the control panel provides for operation control of the laundry device; and a falling off preventive portion provided at a front side of the panel frame to prevent the control panel from falling off of the panel frame, the falling off preventing portion comprising:

a projection that extends from an interior facing side of one of the bent ends of the control panel;

a slot formed in a side of the first bracket opposite the projection, wherein the projection is slidably inserted into the slot by sliding the control panel toward the panel frame;

a moving preventive member that prevents the control panel from moving after the control panel is mounted to the panel frame, the moving preventive member including a screw coupled to the hole formed in the first bracket and the screw hole formed in the control panel; and a hiding cap positioned in the recess so as to simultaneously cover the recess and the screw.

2. A laundry device, comprising:

a body case that forms an exterior of the laundry device;

a panel frame mounted to an upper end or a lower end of a front of the body case, wherein the panel frame includes a bracket that projects from a first side of the panel frame, the bracket having a hole formed therein;

a control panel selectively mounted to a front of the panel frame that provides for operation control of the laundry device, wherein the control panel includes a recess and a screw hole formed in the recess;

a falling off preventive portion formed at a front side of the panel frame, wherein the falling off preventive portion prevents the control panel from detaching from the panel frame; and a moving preventive member that prevents the control panel from moving after the control panel is mounted to the panel frame, wherein the moving preventive member includes:

a screw fastened to the hole formed in the bracket of the panel frame and the screw hole formed in the control panel; and a hiding cap coupled to the recess to simultaneously cover the recess and the screw, wherein the hiding cap includes a holding hook and the recess includes an eye that rotatably holds the holding hook such that the holding hook rotates while the holding hook is held at the eye and the hiding cap selectively exposes or hides the recess and the screw, wherein the recess comprises a seating step formed along a circumferential portion of the recess such that the hiding cap is seated on the seating step, and wherein a portion of the seating step is inclined from a top surface of the seating step toward a bottom of the recess to guide rotation of the hiding cap such that the holding hook rotates in response to depression of a portion of the hiding cap seated on the portion of the seating step that is inclined.

3. The laundry device as claimed in claim 2, wherein the hiding cap includes a holding slot and the recess includes a holding projection.

4. The laundry device as claimed in claim 2, wherein the hiding cap includes a holding projection and the recess includes a holding slot.

5. The laundry device as claimed in claim 1, wherein the panel frame is provided at both the upper end and the lower end of the front of the body case, and wherein the control panel is mounted to the panel frame at one of the upper end or the lower end and a cover panel is mounted to the panel frame on to the panel frame at the other of the upper end or the lower end.

6. The laundry device as claimed in claim 5, wherein a structure that mounts the cover panel to the panel frame and dismounts the cover panel from the panel frame is identical to a structure that mounts the control panel to the panel frame and dismounts the control panel from the panel frame.

7. The laundry device as claimed in claim 2, wherein the panel frame is provided at both the upper end and the lower end of the front of the body case, and wherein the control panel is mounted to the panel frame at one of the upper end or the lower end and a cover panel is mounted to the panel frame at the other of the upper end or the lower end.

8. The laundry device as claimed in claim 1, wherein the projection comprises:

a supporting end formed integrally with the control panel; and a bent end that is bent upward or downward from an inner edge of the supporting end, wherein the slot includes a horizontal leg that receives the supporting end therein and a vertical leg for receiving the bent end therein.

9. The laundry device as claimed in claim 8, wherein the moving preventive member further comprises:

a second bracket that projects forward from the panel frame;

a bracket hole formed in the second bracket;

a screw hole formed in the control panel opposite the bracket hole formed in the second bracket; and a screw fastened in the bracket hole and the screw hole.

10. The laundry device as claimed in claim 9, wherein the first bracket projects forward from a first end of the panel frame, and the second bracket projects forward from a second end of the panel frame.

11. The laundry device as claimed in claim 9, further comprising hinge holes formed in the recess and hinge projections formed on the hiding cap corresponding to the hinge holes such that the hiding cap rotates about an axis defined by the hinge projections inserted in the hinge holes to selectively expose or cover the recess and the screw.

12. The laundry device as claimed in claim 9, further comprising hinge holes formed in the hiding cap and hinge projections formed on the recess corresponding to the hinge holes such that the hiding cap rotates about an axis defined by the hinge projections inserted in the hinge holes to selectively expose or cover the recess and the screw.

13. The laundry device as claimed in claim 9, further comprising an eye formed in on a bottom surface of the recess and a hook provided on the hiding cap corresponding to the eye such that the hook is engaged with the eye and rotates within the eye to rotate the hiding cap and selectively expose or cover the recess and the screw.

14. The laundry device as claimed in claim 9, further comprising a holding slot formed in the hiding cap and a holding projection formed on the recess.

* * * * *